US006564432B1

(12) United States Patent
Kushner

(10) Patent No.: US 6,564,432 B1
(45) Date of Patent: May 20, 2003

(54) PERSONAL ARTICLE HOLDER WITH INSERT DISPLAY

(76) Inventor: Robert Gerald Kushner, 22nd Floor, Flat E, Tower 125, 11 PO Yan Street, Sheung Wan (HK)

( * ) Notice: Subject to any disclaimer, the term of this patent is extended or adjusted under 35 U.S.C. 154(b) by 0 days.

(21) Appl. No.: 10/008,323

(22) Filed: Nov. 13, 2001

(51) Int. Cl.[7] ..... A44B 21/00; A45F 5/00; G02C 5/14

(52) U.S. Cl. ..... 24/3.3; 24/3.11; 24/163 K; 24/523; 24/587.1; 24/306; 40/1.6; 351/112; 351/157

(58) Field of Search ..... 24/3.3, 3.1, 3.11, 24/597, 904, 905, 587.1, 523, 524, 163 K, 3.12; 119/14.1, 865; 248/231.51, 902; 351/112, 156, 157

(56) References Cited

U.S. PATENT DOCUMENTS

| | | | | | |
|---|---|---|---|---|---|
| 3,921,798 | A | * | 11/1975 | Dean et al. | 206/53 |
| 3,927,442 | A | * | 12/1975 | Foster | 24/163 K |
| 4,183,159 | A | * | 1/1980 | Isaac | 40/1.6 |
| 4,570,308 | A | * | 2/1986 | Weisgerber | 24/163 K |
| 4,597,206 | A | * | 7/1986 | Benson | 40/1.6 |
| 4,704,770 | A | * | 11/1987 | Minami et al. | 24/163 K |
| 4,771,515 | A | | 9/1988 | Guarro | |
| 4,941,634 | A | * | 7/1990 | Gomes et al. | 248/902 |
| 4,968,128 | A | * | 11/1990 | Mendola | 351/157 |
| 5,000,410 | A | * | 3/1991 | Beavers | 248/902 |
| 5,137,242 | A | | 8/1992 | Reath | |
| 5,251,795 | A | | 10/1993 | Jeppesen | |
| 5,265,736 | A | | 11/1993 | Orr | |
| 5,351,098 | A | | 9/1994 | McDaniels et al. | |
| 5,408,728 | A | | 4/1995 | Wisniewski | |
| 5,619,774 | A | | 4/1997 | Perry | |
| 5,653,414 | A | * | 8/1997 | Chimel | 248/902 |
| 5,715,538 | A | * | 2/1998 | Soll | 24/306 |
| 5,794,312 | A | | 8/1998 | O'Mahony | |
| 5,860,191 | A | | 1/1999 | Sieger | |
| 5,863,021 | A | * | 1/1999 | Nichols | 248/231.51 |
| 5,921,409 | A | | 7/1999 | Gerber et al. | |
| 5,941,487 | A | | 8/1999 | Keely | |
| 5,975,476 | A | | 11/1999 | Mancinelli | |
| 5,979,019 | A | * | 11/1999 | Johnson | 24/3.11 |
| 5,983,459 | A | | 11/1999 | Goldenberg | |
| 6,102,346 | A | | 8/2000 | Visser | |
| 6,134,753 | A | | 10/2000 | O'Mahony | |
| 6,135,407 | A | | 10/2000 | Havis et al. | |
| 6,206,258 | B1 | | 3/2001 | Calder | |
| 6,210,003 | B1 | | 4/2001 | Chan | |
| 6,273,386 | B1 | | 8/2001 | Boeder | |

* cited by examiner

*Primary Examiner*—Victor Sakran
(74) *Attorney, Agent, or Firm*—Stuart A. Whittington; Squire, Sanders & Dempsey L.L.P.

(57) ABSTRACT

A holder for personal articles such as eyeglasses and sunglasses and the like includes: (i) a clamping body with a transparent window for displaying provided inserts, and (ii) a clip portion attached to the clamping body for attaching the holder to clothing, accessories, automobile visors and other areas.

10 Claims, 4 Drawing Sheets

PERSONAL ARTICLE HOLDER WITH INSERT DISPLAY

BACKGROUND

1. Field of the Invention

The present invention generally relates to a device for holding personal articles such as eyeglasses and the like. More particularly, but not exclusively, the present invention relates to a device that displays personal or business information or images and holds eyeglasses or sunglasses, pens, pencils or any other small object, wherein the device may be attached to any surface such as appliances, furniture, computers, clothing, clothing accessories and flat surfaces such as automobile visors and books.

2. Related Art

Many people periodically wear eyeglasses and/or sunglasses. However, at certain times, a wearer of eyeglasses or sunglasses (collectively referred to herein as "glasses") may wish to remove and store their glasses for short periods when the glasses are not needed. For example, a wearer of sunglasses may remove them during evening hours when sunlight begins to fade. The wearer may typically remove them and place them in a convenient location such as on the dashboard of the car, on an adjacent seat, in a cubbyhole or the like. These locations, while convenient, may subject the glasses to be susceptible to soiling, damage and/or loss. Consequently, there is a need for a holder of personal articles, including glasses, which conveniently stores such items to prevent soiling, damage and/or loss.

Many attempts to provide such a holder have been made, some more successful than others. For example, U.S. Pat. Nos. 6,134,753 and 5,794,312 to O'Mahony disclose holding devices including a clip portion for attaching the holding device to a desired surface and a clamping portion for securing the personal article or glasses.

U.S. Pat. No. 5,941,487 to Keely discloses a retainer for holding eyeglasses that includes a retainer ring rotatably mounted to a clamping means. The clamping means secures the retainer to a desired surface, such as a automobile visor, while the retainer ring receives and secures the temple portion of a pair of eyeglasses.

U.S. Pat. No. 5,975,476 to Mancinelli discloses a holder for securing eyeglasses to a visor including a body and a clip. The body receives the bridge of the eyeglasses with the temple bars of the glasses resting on top of the body. The clip is disposed on a portion of the body and forms a flexible clamp for securing the holder to a visor.

U.S. Pat. No. 5,983,459 to Goldenberg discloses a clip for securing eyeglasses or sunglasses that slides onto an article of clothing. The clip is similar to a conventional money clip but has an elastic material to create a channel for receiving an temple of a pair of glasses.

While these and other known retainers and holders for glasses and other articles may provide effective havens for protecting such items against loss, damage or soiling, none of them are particularly aesthetically pleasing and none are designed to be customized with personal images or inserts for the owner of the holder.

Accordingly, it is desired to provide a personal article holder that may be customized for a particular user by allowing inserts to be displayed. Additionally it is desired to provide a personal article holder that may serve as an advertisement or other promotional item.

SUMMARY OF THE INVENTION

It is an object of the present invention to overcome at least one of the foregoing problems by providing a personal article holder with insert display including an upper arm member hingedly connected to a lower arm member via pivot mechanism and an attachment mechanism for attaching the personal article holder to desired surfaces. The attachment mechanism may be connected to the lower arm member on a side opposite the upper arm member, wherein the upper arm member includes a transparent member for displaying provided inserts placed there behind.

The transparent member may be removed entirely from the upper arm member to facilitate placement of a desired insert such as a photograph or business card. Alternatively, the transparent member may be hingedly connected at one end to the upper arm member to facilitate opening for inserting and removing pictures and other display items.

BRIEF DESCRIPTION OF THE DRAWING

Additional aspects, advantages and features of the present invention will become apparent from the following description in reference to the appended drawing in which like reference numerals denote like elements and in which.

DETAILED DESCRIPTION OF THE PREFERRED EMBODIMENTS

A personal article holder with insert display according one embodiment of the invention includes: a clamping body for securing the personal article and an attachment portion for securing the clamping body to a desired surface. The clamping body may generally include: (i) an upper arm member hingedly connected on one end to (ii) a lower arm member. On an opposite, non-hinged, end of the upper and lower arm members is a clasp means for securing the upper arm member to the lower arm member between closed and open positions. The upper and lower arm members may each include a resilient cushion member that, when the clamping body is in a closed position, face each other to secure personal articles that have been placed there between.

The upper arm member includes, on a side opposite its respective cushion member, a transparent member that facilitates display of objects inserted between the transparent member and the upper arm member. The attachment portion is secured to a bottom surface of the lower arm member, opposite the side of its respective cushion member, so that, when attached to a surface, e.g., a car visor, refrigerator, or other surface, the object inserted behind the transparent member is viewable by a person.

Figure 1:
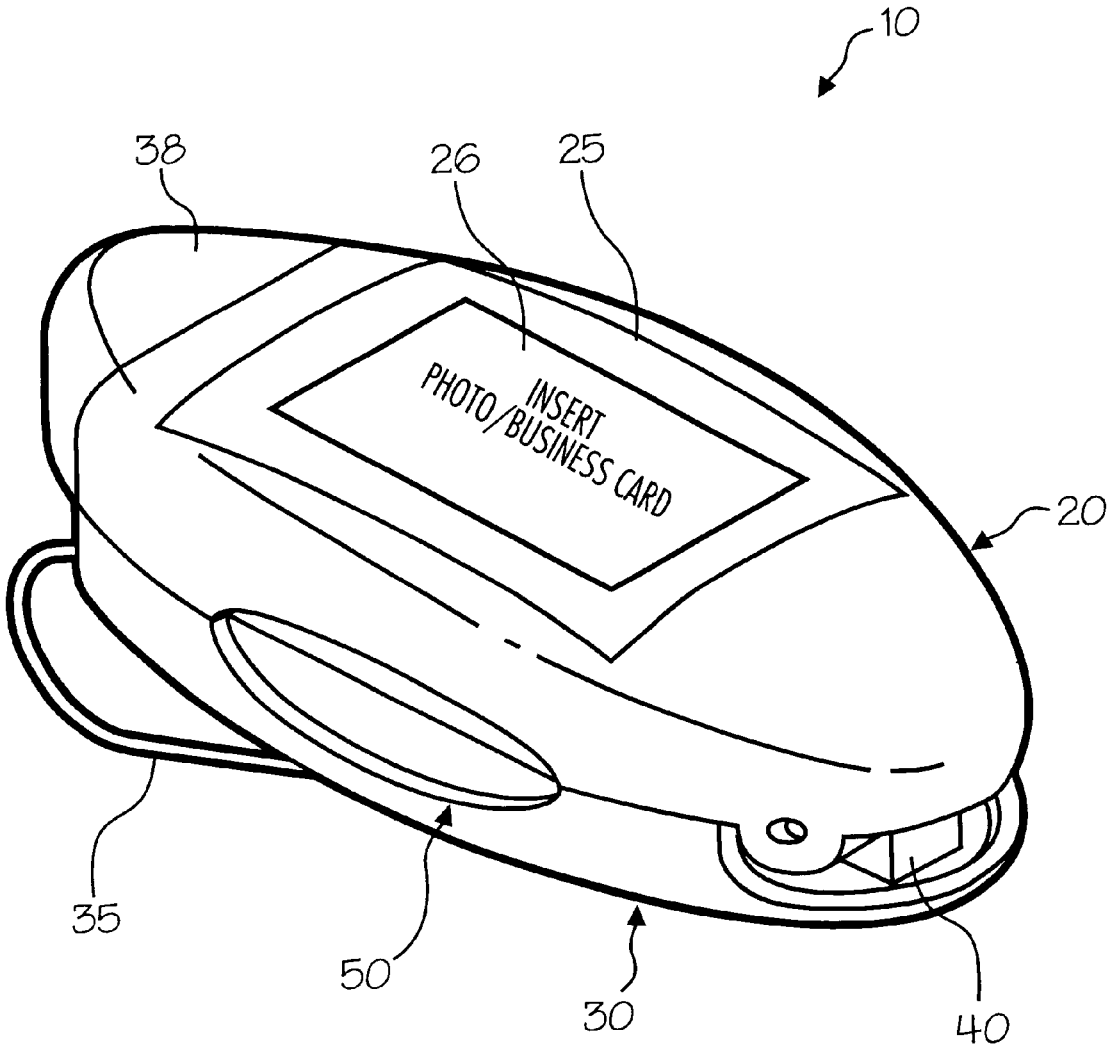
FIG. 1 illustrates a perspective view of a preferred personal article holder of the invention.

FIG. 1 illustrates a perspective view of a personal article holder with insert display 10 according to a preferred embodiment of the invention. As shown, holder 10 includes a clamping body including upper arm 20 and lower arm 30 connected at one end by a pivot or hinge 40. The clamping body includes a space 50 between the upper arm 20 and lower arm 30 for securing portions of a personal article transverse to holder 10. An attachment portion 35 is fixed to the lower arm 30 of the clamping body so that the clamping body may be attached to a variety of different surfaces.

Upper arm 20 includes transparent member 25 for displaying and/or protecting an insert 26, such as a photograph or business card. As used herein, "transparent" means a material having the property of transmitting light without appreciable scattering and can include clear as well as colored appearance. Transparent member 25 may be a fixed frame having a slot for insertion of insert 26 or may be a removable or opening panel as discussed further below in reference to FIGS. 3A and 3B.

Figure 2A:
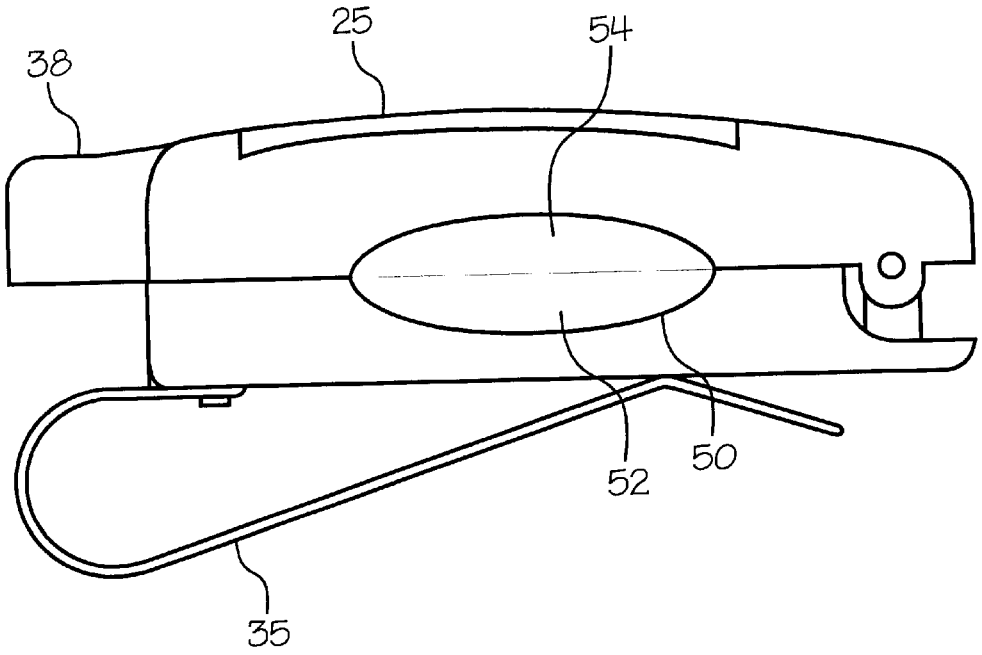
FIGS. 2A and 2B illustrate side views of a personal article holder with insert display of a preferred embodiment.
Figure 2B:
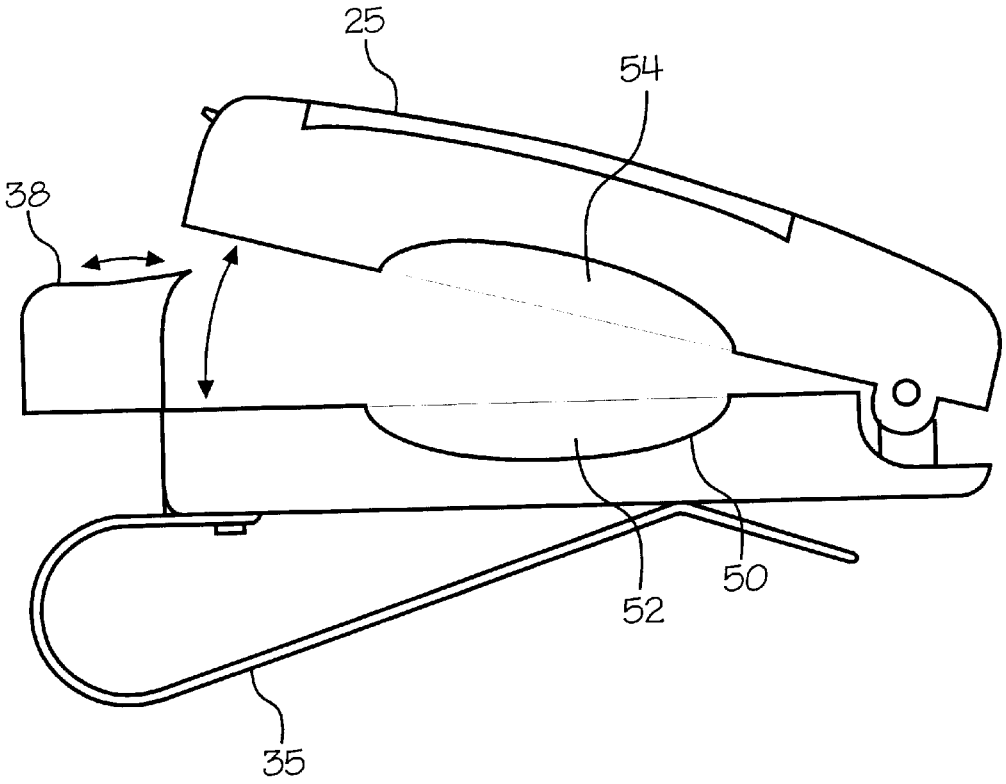

FIGS. 2A and 2B illustrate side views of holder 10 in closed and open positions respectively. Lower arm 30 preferably includes a latch portion 38 that serves to fasten holder 10 between open and closed positions. As shown in FIG. 2B, latch portion 38 of lower arm 30 extends in a longitudinal direction to catch and release a ribbed portion of upper arm 20 to serve as a clasping means.

Holder 10 also includes cushion members 52 and 54 for gently but securely stowing portions of a personal article disposed in space 50 when holder 10 is in a closed position. As shown, upper arm 20 has cushion member 54 disposed on a lower or inside surface thereof. Conversely, lower arm 30 has cushion member 52 disposed on an upper or inside surface as well. Cushion members 52 and 54 may be fixed or removably attached to respective arms 20, 30 in any manner for one material to be secured to another, e.g., snaps, adhesive, Velcro, etc. In one embodiment, cushion members 52 and 54 are fixed to the interior of the upper and lower arms using an adhesive. When the clamping body is in a closed position, cushion members 52 and 54 may abut against one another or be separated by a small gap for gripping a portion of a personal article placed there between.

Transparent member 25 may be any substantially transparent material suitable for providing visibility and protection of insert 26, such as plastic or glass. In one embodiment transparent member 25 is formed using a general purpose polystyrene (GPPS) material.

Upper arm 20 and lower arm 30 of the clamping body may be made from any material rigid enough to provide support for a personal article, such as rigid plastics, ceramics, metals, woods or any combination thereof. In one embodiment, upper and lower arms are formed in an injection mold using an ABS (Acrylonitrile-Butadiene-Styrene) plastic material, which may be tinted or colored to achieve a desired color. ABS plastics are used in preferred embodiments since they possess high strength and durability material characteristics and readily accept plating and painting to vary appearance and design of the device. The clamping body is illustrated in an oval shape but may be formed in any desired shape such as a circle, a rectangle, a square, a trapezoid or any other symmetrical or asymmetrical shape. The clamping body may be formed in any size, shape or color desired, suitable for holding personal articles.

Pivot 40 may be any type of rotating connector between upper arm 20 and lower arm 30. In one embodiment pivot 40 comprises an axial pin disposed through holes formed in the injection mold plastic of the respective upper and lower arms. In another embodiment, pivot 40 comprises divots or holes in an end of one arm (upper or lower) and corresponding protrusions in the opposite arm that mate with the divots or holes.

Latch portion 38 may be any type of mechanism or arrangement for clasping upper arm 20 and lower arm 30 together in a secured, or non-opening, position. In one embodiment, latch portion 38 is a flexible receiving portion of lower arm 30 adapted to receive a protrusion or ridge extending from upper arm 20 similar to the illustration in FIG. 2B. When downward pressure (with respect to upper and lower arms) is exerted on a top surface of latch portion 38 it moves outward thereby releasing upper arm 20.

Cushions members 52 and 54 may be any deformable material suitable for securing portions of a personal article without causing damage when holder 10 is in a closed position. In a preferred embodiment cushion members 52 and 54 are foam inserts made of EVA (Ethylene-Vinyl Acetate) material that is cemented to interior portions of respective upper and lower arms.

Attachment portion 35 may be any mechanism or arrangement for facilitating temporary or permanent fixation of clamping body to other surfaces. Examples of attachment portion 35 include a clip, magnet, Velcro, suction cup, double sided tape, etc. In one embodiment, attachment portion 35 is a tensioned wire attached to lower arm 30 similar to, but not limited to, the examples shown in FIGS. 2A and 2B. In this embodiment, holder 10 may be utilized as a bookmark by clipping a desired portion of a book between wire 35 and lower arm 30. In another embodiment attachment portion 35 is a segment of double-sided tape (not shown) having one side adhere to the clamping body and readily attachable to a desired surface, such as a computer monitor, using the adhesive opposite side.

Figure 3A:
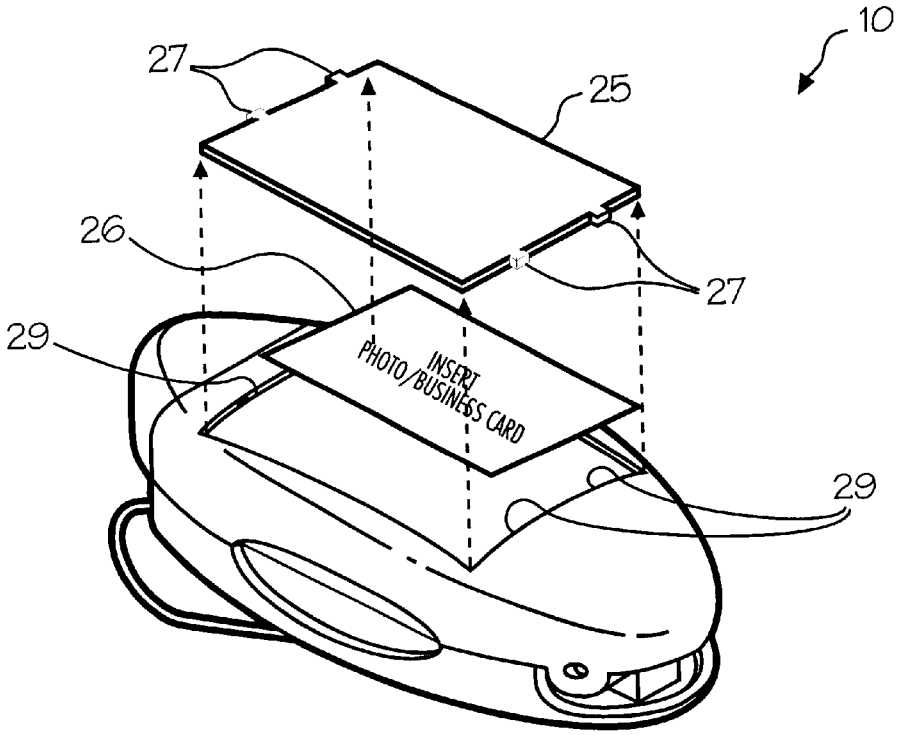
FIGS. 3A and 3B illustrate perspective views of personal article holders having alternative types of transparent members.

FIG. 3A illustrates an embodiment of the present invention in which transparent member 25 is a removable panel fitting into a corresponding recess in upper arm 20. As shown in this example, panel 25 includes one or more tabs 27 and upper arm 20 includes one or more corresponding recesses, slots or ridges 29 for receiving and securing tabs 27. In this embodiment, panel 25 is preferably a flexible transparent plastic so that, when panel 25 is compressed into a crescent shape, tabs 27 may be inserted into, or removed from, recesses 29. In a modification of this embodiment, upper arm 20 may include tabs or ridges for securing edges of panel 25 that do not include tabs 27.

Figure 3B:
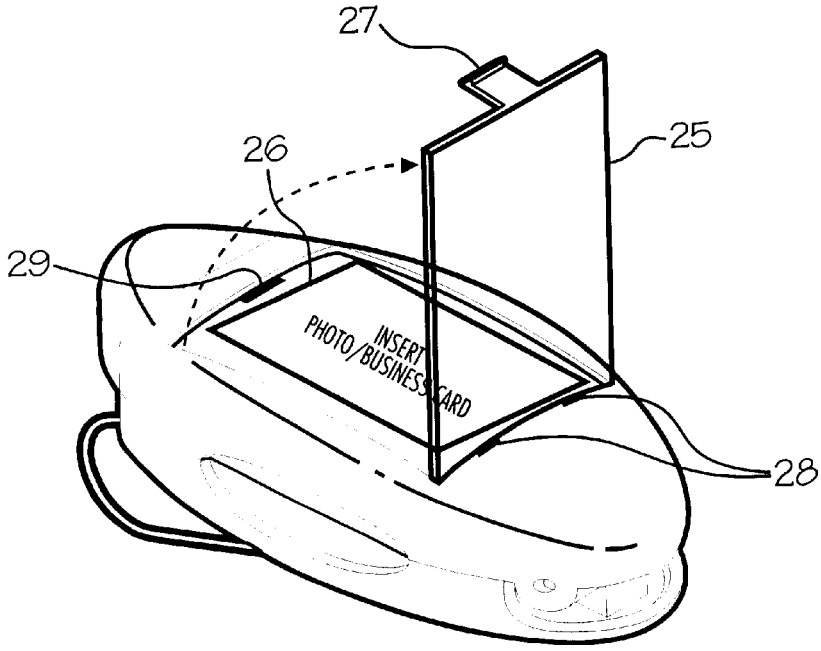

FIG. 3B illustrates another embodiment of the invention in which transparent member 25 opens to facilitate placement of insert 26. In this embodiment, transparent member 25 is a transparent plastic (rigid or flexible) hingedly connected to upper arm 20 on one end, e.g., using hinges 28. On an opposite end of transparent member 25 is tab 27 for securing into slot 29. Slot 29 may include a release mechanism (not shown) for releasing and securing tab 27 of transparent member 25. Hinges 28 may be any type of arrangement for facilitating rotation of transparent member 27 between open and closed positions. In one embodiment, hinges 28 are C-shaped plastic extensions of member 25 that rotate around corresponding axial members formed in upper arm 20.

With any of the foregoing arrangements for transparent member 25, a user of holder 10 may add, remove or replace insert 26 when desired. While transparent member 25 is illustrated in the drawing as a rectangular shaped window, it should be recognized that transparent member may be formed in any desired shape including, for example, ovals, circles, squares and any other symmetrical or asymmetrical shape.

Figure 4B:
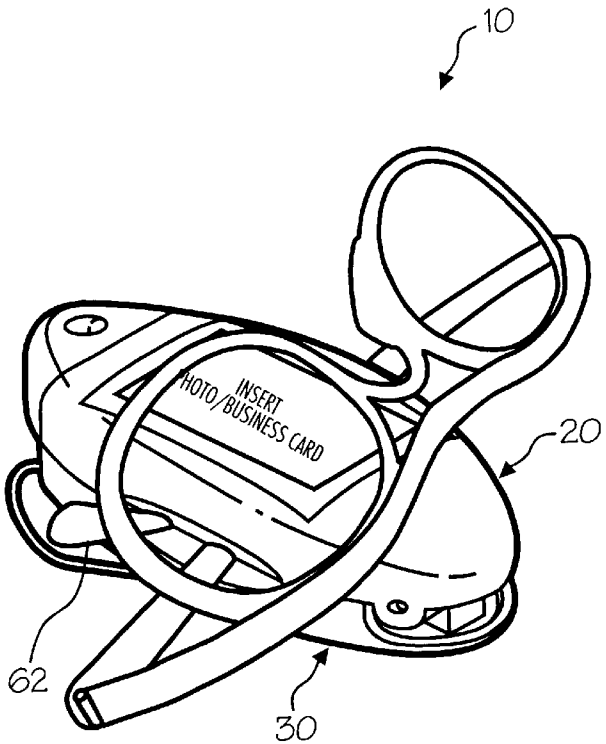
FIGS. 4A and 4B illustrate respective top and perspective views of an example personal article holder securing a pair of eyeglasses.
Figure 4A:
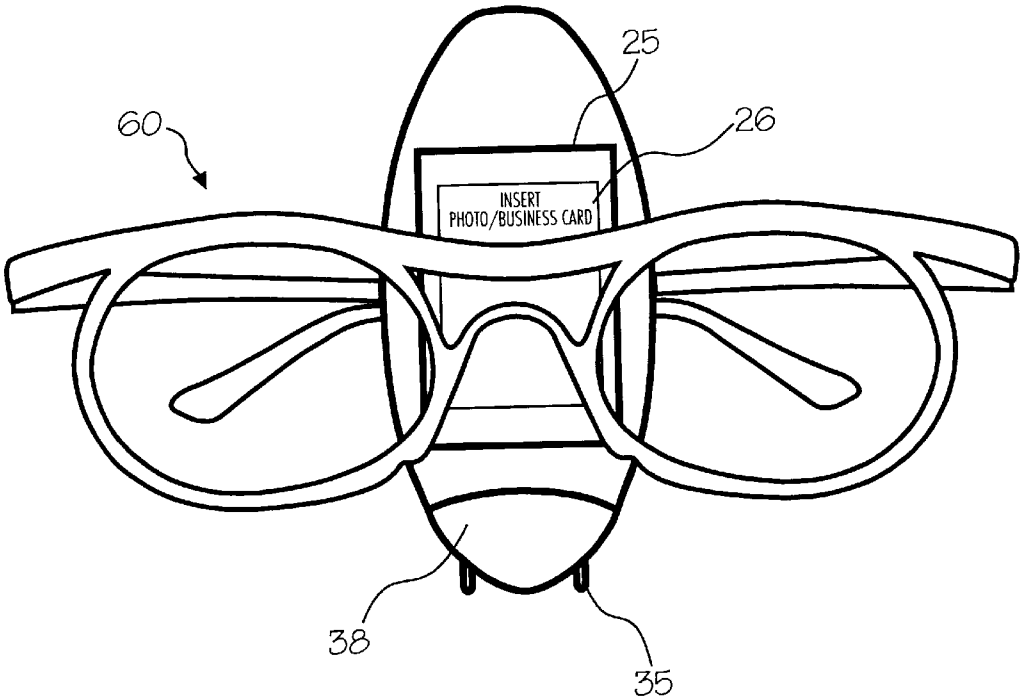

FIGS. 4A and 4B illustrate top and perspective views of holder 10 holding a personal article, for example, eyeglasses 60. As shown, temple bars 62 of eyeglasses 60 are supported between upper arm 20 and lower arm 30 when holder 10 is in a closed position. Insert 26 is readily viewable through transparent member 25 thus rendering a personal article holder that is customized for the user of eyeglasses 60 displaying insert 26 of the user's choosing. Additionally, although not shown, holder 10 serves as an effective advertising and promotional medium in that an advertiser may distribute holder 10 with a business card or other promotional information serving as insert 26.

Unless contrary to physical possibility, the inventor envisions the apparatuses described herein may have the components of respective embodiments combined in any manner.

Although there have been described preferred embodiments of this novel invention, many variations and modifications are possible and the embodiments described herein are not limited by the specific disclosure above, but rather should be limited only by the scope of the appended claims.

What is claimed is:

1. A personal article holder comprising:

a clamping body having a clamping position and an open position and comprising an upper arm; a lower arm pivotally connected at one end thereof, to a corresponding end of the upper arm; and a transparent member disposed on an outer surface of the clamping body and operative to display a provided insert wherein the transparent member comprises a rigid transparent panel rotatably connected on an end thereof to the clamping body and operative to be displaced outwardly from said outer surface for adding and removing the provided insert;

attachment means connected to the clamping body for attaching the clamping body to a desired surface; and a cushion member disposed on opposing surfaces of each of the upper and lower arms, wherein the cushion members are operative to secure a personal article there between when the upper and lower arms are in the clamped position.

2. The personal article holder of claim 1 wherein the attachment means comprises a member attached to the clamping body, the member selected from the group consisting of a clip, a magnet, a segment of tape, and a suction cup for attaching the clamping body to the desired surface.

3. A holder for supporting and securing objects comprising:

an upper arm member having a first cushion disposed on a bottom side thereof and a transparent panel for displaying inserts disposed on a top side thereof, the transparent panel comprising a rigid transparent plastic material having one or more tabs for securing the transparent panel to the upper arm, the transparent panel operative to be displaced outwardly from the top side of said upper arm member to add and remove a provided insert;

a lower arm member including a second cushion member, the lower arm member having a side thereof hingedly attached to a corresponding side of the upper arm member such that the upper and lower arm members form a clamping body whereby the first and second cushions face one another to secure an article there between when said upper and lower arm members are in a closed position; and an attachment portion fixed to a surface of the lower arm member opposite the second cushion member, the attachment portion for attaching the holder to a desired surface.

4. The holder of claim 3 wherein said upper and lower arm members are at least partially composed of an injection molded plastic.

5. The holder of claim 4 wherein the attachment portion comprises a tensioned wire.

6. The holder of claim 3 wherein the transparent panel is hingedly attached to said upper arm member.

7. The holder of claim 3 wherein the attachment portion comprises a segment of double-sided tape.

8. The holder of claim 3 wherein the attachment portion comprises a magnet.

9. The holder of claim 3 wherein the attachment portion comprises a clip.

10. The holder of claim 3 wherein the attachment portion comprises a segment of VELCRO material.

* * * * *